United States Patent [19]

Sacks

[11] 3,980,127

[45] Sept. 14, 1976

[54] ENERGY CONSERVATION SYSTEM

[75] Inventor: Bernard Sacks, Philadelphia, Pa.

[73] Assignee: Patco Inc., Pennsauken, N.J.

[22] Filed: May 6, 1974

[21] Appl. No.: 467,040

[52] U.S. Cl. ..... 165/2; 165/16; 165/48; 98/33 A

[51] Int. Cl.[2] ..... F25B 13/00

[58] Field of Search ..... 98/33 A, 38 B, 38 E, 98/40 D; 165/16, 35, 36

[56] References Cited

UNITED STATES PATENTS

| | | | |
|---|---|---|---|
| 2,144,693 | 1/1939 | Seid | 165/16 X |
| 3,376,916 | 4/1968 | Gressett | 98/38 B X |
| 3,433,295 | 3/1969 | Avery | 165/35 |
| 3,669,349 | 6/1972 | Hall, Jr. | 165/16 X |
| 3,720,258 | 3/1973 | Chandler | 165/16 X |

*Primary Examiner*—Albert W. Davis, Jr.
*Assistant Examiner*—James D. Liles
*Attorney, Agent, or Firm*—Seidel, Gonda & Goldhammer

[57] ABSTRACT

Rooms of a building are provided with an air distributing ceiling and plenum chambers thereabove. Treated air is pumped to the plenum chambers where it passes through the ventilating ceiling to heat or cool an enclosed area below. A recirculation system permits withdrawal of all of the treated air from the enclosed area. The withdrawn air is recirculated after mixing with freshly treated air. The air is treated by passing a portion thereof over a heating or cooling coil while the remainder bypasses the coil. The mixture of treated and bypass air is pumped at a high rate into the plenum chambers where a static pressure such as 1 inch of water exists.

7 Claims, 3 Drawing Figures

ENERGY CONSERVATION SYSTEM

BACKGROUND OF THE INVENTION

The present invention relates to energy conservation systems and, more particularly, to an efficient system for heating and cooling a building while using a minimal amount of energy.

Conventional systems used for heating or cooling a building require large amounts of duct work to transmit conditioned air to each enclosed space, such as a room or a hall. Each enclosed space requires a separate duct for transmitting conditioned air to that space. When large numbers of spaces must be conditioned, an intricate network of ducts is required. This is particularly objectionable in light of the capital outlay for manufacturing, installing, and maintaining the ducts.

In addition, quite frequently the utilization of the space varies. Ordinarily, movable partitions are used to create specific offices within the space. Different office plans, then, require the rearrangement of these partitions. In the conventional system, each area enclosed by the partitions must be properly ventilated and this requires the location of one or more ducts in each area. Therefore, the number of office plans available will be limited because the ducts are installed at fixed locations.

Further, conventional systems for heating or cooling a building must be tailored to meet the requirements of the space to be treated. Therefore, the design of the conditioning system cannot be completed until the arrangement of the building space is determined.

Moreover, in air conditioning a building having ventilating ceilings using normal parameters the effective flow of air through the ventilating ceiling diminishes as the air travels away from the source. As a result, the effective flow of treated air through the ventilating ceiling will be non-uniform and portions of the space below may not be conditioned acceptably.

A principal advantage of the present system is that the component used for treating the environmental air is more efficiently utilized, permitting a reduction in energy consumption with an increased flow of treated air into the conditioned space.

A further advantage of the present invention is that the entire enclosed space is conditioned by the treated air and this space can be arranged in a wide variety of partitioning schemes.

An additional advantage of the present invention is that it can be designed without waiting for the completion of the design of specific partition arrangements and that identical air treating units can be utilized thereby minimizing construction expense.

Another advantage of the present invention is that the conditioning system is located above the space being conditioned, permitting more profitable utilization of that space.

A still further advantage of the present invention is that it is easy and inexpensive to maintain.

Other advantages will appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
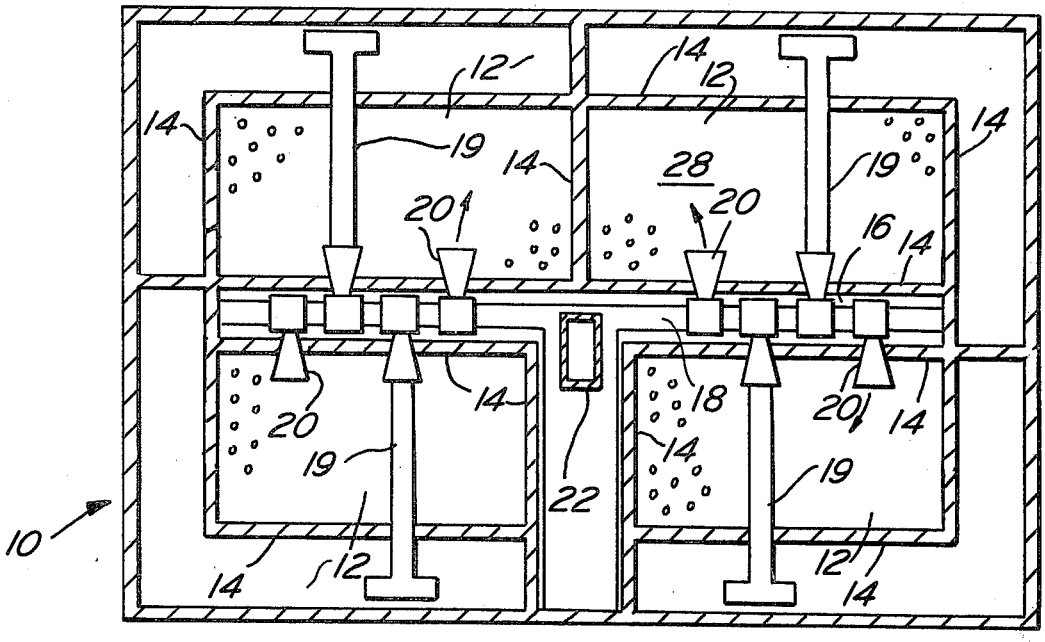
FIG. 1 is a plan view of an energy conservation system constructed in accordance with the principles of the present invention.

Referring to the drawings in detail, wherein like numerals indicate like elements, in FIG. 1 there is shown a portion of a building having a system 10 constructed in accordance with the principles of the present invention. The system 10 includes plenum chambers 12 and a central corridor or mixed air plenum 16, both formed by zone barriers 14 between the floor of a building and the ceiling therebelow. The zone barriers 14 may be metallized kraft paper, gypsum board or any other similar material. The mixed air plenum 16 is provided with pumps 20 which pump heated or cooled (treated) air into plenum chambers 12. A pumping unit 18 may be mounted on the roof of the building to deliver environmental air to intake duct 22. The unit 18 can be a conventional air treating unit that may be utilized to initially treat the intake air to reduce the temperature variance of the intake air being pumped into duct 22.

Figure 2:
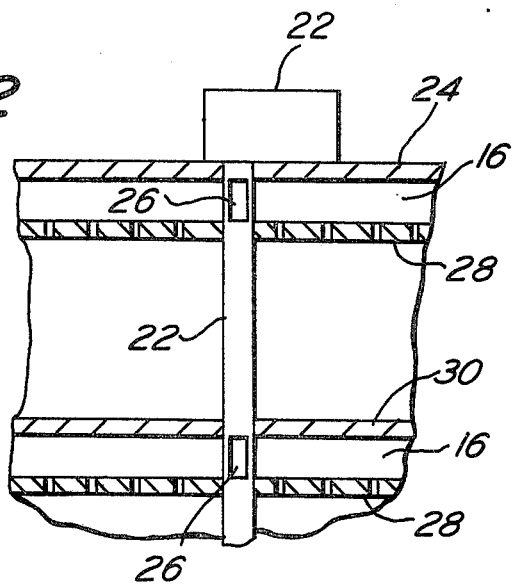
FIG. 2 is a side elevational view of two adjacent floors and ceilings in a building containing the system of the present invention.

Environmental air is introduced into the system through centrally located intake duct 22. The arrangement and operation of intake duct 22 is more clearly shown in FIG. 2. There, intake duct 22 is shown connected to a unit mounted on building roof 24 in communication with unit 18. Duct 22 extends downwardly from the building roof 24, where the environmental air is first drawn into the system, towards the ground level (not shown) of the building. The environmental air, then, is carried to the mixed air plenum 16 through duct 22.

Each room in the building has a floor 30 and a ceiling 28. Ceiling 28 is composed of air distribution sound deadening tiles which readily permit the passage of air therethrough. The ceiling tiles, for example, may be 2 feet by 4 feet. The space between the ceiling 28 and the floor 30 next above is divided into discrete plenum chambers 12. The pumps 20 are interposed within mixed air plenum 16. The environmental air drawn through intake duct 22 is fed to the mixed air plenum 16 on each floor of the building by way of an outlet 26. The air within plenum 16 is pumped into plenum chambers 12 by the pumps 20.

Figure 3:
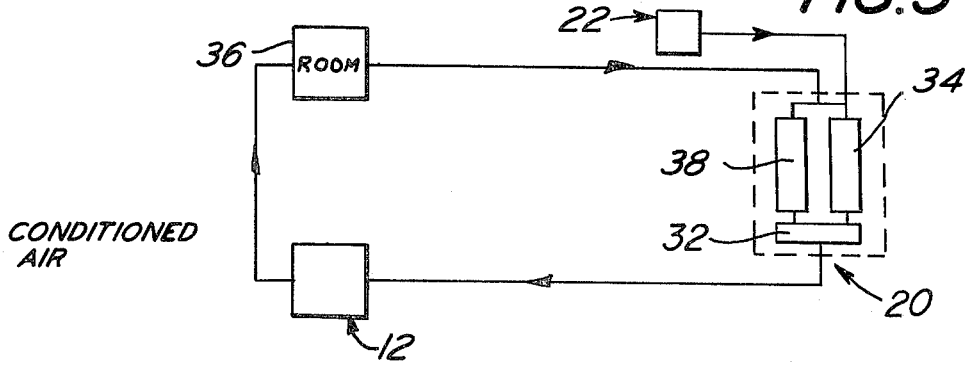
FIG. 3 is a diagram illustrating the recirculation of heated or cooled air in the present invention.

Referring now to FIG. 3, pump 20 is shown to include blower 32 and coil 34. The environmental air introduced into duct 22 and fed to pump 20 is treated by its coil 34. The treated air is pumped by blower 32 into the plenum chambers 12 associated therewith. The treated air flows through each ventilating ceiling 28 into the underlying room. All of the treated air is recirculated such as by being drawn from the hallways into mixed air plenum 16 located on each floor. The air in the hallway includes the treated air which has moved through ventilating ceiling 28 into the rooms to condition the same.

The air in mixed air plenum 16 including recirculated and intake air is fed back to the suction side of pump 20 where all of the mixed air is fed directly to blower 32. A portion of the mixed air fed directly to blower 32 bypasses coil 34 by means of a bypass 38 which may contain a valve (not shown). Accordingly, mixed air fed directly from blower 32 to the bypass 38 is not treated by coil 34. This untreated portion of the mixed air is then mixed with the treated air. Then, the mixture is pumped into plenum chambers 12.

In this manner, the quantum of air flowing into the plenum chambers 12 is increased. Consequently, the pressure inside the chambers 12 is increased, resulting in a static pressure therein such as 1 inch of water, with a greater flow of treated air through the ventilating ceiling 28 into the conditioned room below. The increased volume of air flowing into the room will result in greater comfort to occupants thereof. At the same time, the energy consumed in conditioning the room is reduced because coil 34 only treats a portion of the mixture of environmental air and recirculated air. That is, coil 34 operates substantially as before although the quantum of air flowing into the plenum chambers 12 has been substantially increased.

The present invention also eliminates a substantial portion of the duct work otherwise required in heating or cooling a building. Since the air flows through ventilating ceiling 28 the system 10 avoids the disadvantages of localized ducts. The conditioned room can be partitioned in any manner with each portion receiving conditioned air by means of the portion of the ventilating ceiling 28 thereabove. In addition, the entire partitioning operation can take place over a relatively short period of time. Moreover, the system 10 can be designed without waiting for the completion of the design of specific partition arrangements for each office. In other words, the conditioning system can be designed, without costly delay, before the completion of the interior space design of the building.

It is necessary to provide ducts 19 from the pumps 20 to the outside plenum chambers 12. It is preferred that all pumps 20 be located in plenum 16. However, it is possible to locate pumps 20 immediately adjacent each chamber 12. In such a situation, ducts 19 would extend from plenum 16 to permit air to be drawn into pumps 20 that feed air into the outside plenum chambers 12.

The present invention also permits the selection of a pump for heating and cooling a building which may be standardized for mass production. By using identical pumps, the system 10 will be inexpensive to manufacture, install and maintain. Also, the present invention avoids the complexities of design entailed in constructing a building to accommodate a complex network of ducts. Instead, the building may be constructed based upon standardized pumps. All standardized pumps operate on the same quantities of energy, include the same equipment, and cost the same.

The size of each plenum chamber 12 can be varied so that the standard pump 20 will function properly therewith. Accordingly, many factors can be considered when designing each plenum chamber 12 such as exposure, whether inside or outside space is being treated, normal wind direction, and the like. Thus, rather than provide pumps to meet the needs of pre-sized plenum chambers 12, the plenum chambers 12 are designed so that the standard pump will function properly therewith.

In particular, in one embodiment of the present invention, the flow of treated air produced by a conventional five ton pump can be increased from approximately 2,000 cubic feet per minute to approximately 3,300 cubic feet per minute with a 4 square foot coil. As a result, the flow of treated air through the ventilating ceiling 28 to the room below is increased. Due to the increased flow through ceiling 28, the entire room below will be conditioned acceptably. Similar results are anticipated for pumps of different size.

In the present invention, where a building has already been constructed, the size and the weight of the pumps 20, ducts 19 and intake duct 22 will depend simply upon the conventional dimensions for the space between adjacent ceilings and floors since the duct work will be contained within this space. Thus, buildings can be outfitted with the energy conservation system 10 of the present invention by relatively simple design. By locating the system 10 between adjacent ceilings and floors, the conditioned rooms may be utilized more effectively and the operation of the building may be made more commercially attractive. No floor space is required for the pumps. Furthermore, by locating the pumps in the space above the ceiling, maintenance of the system 10 is made easy by removing the appropriate ceiling tile. In particular, the system 10 can be repaired without interfering with office working space.

A summary of the operation of the system 10 of the present invention proceeds as follows. Environmental air is introduced into intake duct 22 and may be initially heated or cooled by a coil provided in unit 18. The initially treated air is mixed with recirculated air and pumped by blower 32 in pump 20 into plenum chambers 12. The air inside the chambers 12 flows through ventilating ceiling 28, thereby heating or cooling the enclosed room below. The air inside the room flows into the hallways and is drawn through the hallway ceiling into mixed air plenum 16. The mixture of recirculated air and environmental air in plenum 16 is fed to a blower 32. A portion of the mixed air is delivered by blower 32 to the coil 34. The remainder of the mixture not delivered to coil 34 is delivered to an internal bypass 38. The air treated by coil 34 is mixed with the air exiting from the internal bypass 38. The resultant mixture of air is pumped into a chamber 12 by the pumps 20 by means of blower 32. In this manner, the flow of air into chambers 12 is greatly increased. At the increased air flow, the consumption of energy in heating or cooling the building is significantly reduced.

Each pump 20 is part of a closed loop associated with all of the pumps of the building. When operating in the heating mode, the water circulating through the pumps 20 may be heated by other pumps 20 or associated with a solar collector, electrical heaters, or any other device.

The size of coil 34 and the air velocity imparted by its associated blower 32 is important. If the coil size air velocity ratio is improper, the air can be cold and damp due to too high relative humidity or warm and dry due to a too low relative humidity. A pleasing environment can be attained by the following formula:

$$\text{room air temp} = \frac{A \times B + C \times D}{CF_M}$$

wherein A is the leaving air temperature off of coil 34, B is the nominal cubic feet per minute for the coil as designated by the manufacturer, C is the temperature of the air which bypasses coil 34, D is the cubic feet per minute of air which bypasses coil 34, and CFM is total cubic feet per minute pumped into a plenum chamber 12.

The ventilating ceiling 28 is of such a design so that a laminar flow of air is achieved thereby minimizing the possibility of cold or hot spots within the room being treated. A desired minimum ratio is approximately (½) square inch of opening for each square foot of ceiling tile. Greater ratios can be used without departing from the spirit and scope of this invention. Due to the laminar flow it is possible to minimize aspiration of room air. Aspiration of room air is undesirable since it normally results in the deposition of dirt and smudging of the ceiling tiles.

The present invention may be embodied in other specific forms without departing from the spirit or essential attributes thereof and, accordingly, reference should be made to the appended claims, rather than to the foregoing specification as indicating the scope of the invention.

I claim:

1. An air circulation system comprising a building having intake means for withdrawing air from the environment;

a plurality of uniformly sized means on one floor of the building for treating said environmental air by heating or cooling having a predetermined air treating capacity, each of said treating means being in communication with said intake means;

a plurality of means for pumping said treated environmental air, the suction sides of said pumping means being in communication with said air treating means;

a ventilating ceiling;

a plurality of pre-designed plenum chambers disposed above said ceiling, each of said chambers being in communication with a separate one of said pumping means such that air pumped by each pumping means flows into its respective chamber and through said ventilating ceiling to the area beneath said ceiling; and recirculation means in communication with said area beneath the ceiling and with said pumping means for exhausting the treated air from the enclosed area beneath the ceiling and for conducting the air back to said pumping means so that said recirculated air is mixed with said treated environmental air and said mixture is pumped into each plenum chamber whereby the volume of air pumped into each plenum chamber is greater than the air treating capacity of the treating means.

2. A system according to claim 1 including barrier means dividing the space above said ceiling into a plurality of plenum chambers each of which is substantially smaller than the area beneath said ceiling.

3. A system according to claim 1 wherein said recirculation means is in direct communication with air intake means, said recirculating air and said environmental air being mixed prior to contact with said pumping means, said mixture being in direct communication with said pumping means whereby at least a portion of said mixture bypasses said treating means.

4. A system in accordance with claim 1 including a common manifold for each air treating means on said one floor of the building.

5. A method of controlling the temperature of a room in a building having space between the ceiling and the floor thereabove including the steps of providing a plurality of uniformly sized air treating units that include a blower and an air treating element designed to operate at a predetermined capacity, locating a plurality of said air treating units in said space, dividing the space into a plurality of discrete plenum chambers with the size of each plenum chamber being designed to have a desired volume of treated air delivered thereto by one of the air treating units associated therewith, introducing air from the environment to the air treating units, providing ventilating ceilings within the building to permit treated air to flow therethrough from said chambers to a room therebelow, recirculating at least a portion of the treated air from a room through the air treating units, and bypassing the air treating element of the air treating unit with a portion of the recirculated air whereby the volume of the air to be introduced into each plenum chamber is greater than would normally be provided if each air treating element was being utilized to its designed capacity.

6. A method as set forth in claim 5 including the steps of using a vertical conduit in a multistory building for the introduction of environmental air to said treating units in said space at each floor level, mixing the environmental air and recirculated air, and bypassing the air treating element of the air treating unit with a portion of the air mixture.

7. A method in accordance with claim 5 including pumping a volume of air which is 33 to 66% greater than the designed capacity of each air treating element into each plenum chamber.

* * * * *